US005868217A

United States Patent [19]

Hines

[11] Patent Number: 5,868,217

[45] Date of Patent: Feb. 9, 1999

[54] SUSPENDED WORK PLATFORM

[76] Inventor: Stephen P. Hines, 1019 E. 1500 North, Layton, Utah 84040

[21] Appl. No.: 865,298

[22] Filed: May 29, 1997

[51] Int. Cl.[6] ..... E04G 3/10

[52] U.S. Cl. ..... 182/37; 182/142

[58] Field of Search ..... 182/36, 37, 142

[56] References Cited

U.S. PATENT DOCUMENTS 1,429,012 9/1922 Andrews ..... 182/142
3,602,335 8/1971 Gustetic ..... 182/37
5,074,382 12/1991 Do ..... 182/142

*Primary Examiner*—Alvin Chin-Shue

[57] ABSTRACT

A new suspended work platform for providing a platform for working on projects that can be raised out of the way when not in use. The inventive device includes a support structure, a platform member, and a suspension structure for suspending the platform member from the support structure. The suspension structure includes a vertical adjustment member, a translational adjustment member, and a turret member to allow adjustment of the vertical position, the horizontal translational position, and the horizontal orientation of the platform member in relation to the support structure.

8 Claims, 4 Drawing Sheets

SUSPENDED WORK PLATFORM

BACKGROUND OF THE INVENTION

1. Field of the Invention

The present invention relates to working platforms and more particularly pertains to a new suspended work platform for providing a platform for working on projects that can be raised out of the way when not in use.

2. Description of the Prior Art

The use of working platforms is known in the prior art. More specifically, working platforms heretofore devised and utilized are known to consist basically of familiar, expected and obvious structural configurations, notwithstanding the myriad of designs encompassed by the crowded prior art which have been developed for the fulfillment of countless objectives and requirements.

Known prior art working platforms include U.S. Pat. No. 4,848,516; U.S. Pat. No. 4,074,792; U.S. Pat. No. 4,678,085; U.S. Pat. No. 4,455,805; U.S. Pat. No. 4,840,278; and U.S. Pat. No. Des. 311,834.

While these devices fulfill their respective, particular objectives and requirements, the aforementioned patents do not disclose a new suspended work platform. The inventive device includes a support structure, a platform member, and a suspension structure for suspending the platform member from the support structure. The suspension structure includes a vertical adjustment member, a translational adjustment member, and a turret member to allow adjustment of the vertical position, the horizontal translational position, and the horizontal orientation of the platform member in relation to the support structure.

In these respects, the suspended work platform according to the present invention substantially departs from the conventional concepts and designs of the prior art, and in so doing provides an apparatus primarily developed for the purpose of providing a platform for working on projects that can be raised out of the way when not in use.

SUMMARY OF THE INVENTION

In view of the foregoing disadvantages inherent in the known types of working platforms now present in the prior art, the present invention provides a new suspended work platform construction wherein the same can be utilized for providing a platform for working on projects that can be raised out of the way when not in use.

The general purpose of the present invention, which will be described subsequently in greater detail, is to provide a new suspended work platform apparatus and method which has many of the advantages of the working platforms mentioned heretofore and many novel features that result in a new suspended work platform which is not anticipated, rendered obvious, suggested, or even implied by any of the prior art working platforms, either alone or in any combination thereof.

To attain this, the present invention generally comprises a support structure, a platform member, and a suspension structure for suspending the platform member from the support structure. The suspension structure includes a vertical adjustment member, a translational adjustment member, and a turret member to allow adjustment of the vertical position, the horizontal translational position, and the horizontal orientation of the platform member in relation to the support structure.

There has thus been outlined, rather broadly, the more important features of the invention in order that the detailed description thereof that follows may be better understood, and in order that the present contribution to the art may be better appreciated. There are additional features of the invention that will be described hereinafter and which will form the subject matter of the claims appended hereto.

In this respect, before explaining at least one embodiment of the invention in detail, it is to be understood that the invention is not limited in its application to the details of construction and to the arrangements of the components set forth in the following description or illustrated in the drawings. The invention is capable of other embodiments and of being practiced and carried out in various ways. Also, it is to be understood that the phraseology and terminology employed herein are for the purpose of description and should not be regarded as limiting.

As such, those skilled in the art will appreciate that the conception, upon which this disclosure is based, may readily be utilized as a basis for the designing of other structures, methods and systems for carrying out the several purposes of the present invention. It is important, therefore, that the claims be regarded as including such equivalent constructions insofar as they do not depart from the spirit and scope of the present invention.

Further, the purpose of the foregoing abstract is to enable the U.S. Patent and Trademark Office and the public generally, and especially the scientists, engineers and practitioners in the art who are not familiar with patent or legal terms or phraseology, to determine quickly from a cursory inspection the nature an essence of the technical disclosure of the application. The abstract is neither intended to define the invention of the application, which is measured by the claims, nor is it intended to be limiting as to the scope of the invention in any way.

It is therefore an object of the present invention to provide a new suspended work platform apparatus and method which has many of the advantages of the working platforms mentioned heretofore and many novel features that result in a new suspended work platform which is not anticipated, rendered obvious, suggested, or even implied by any of the prior art working platforms, either alone or in any combination thereof.

It is another object of the present invention to provide a new suspended work platform which may be easily and efficiently manufactured and marketed.

It is a further object of the present invention to provide a new suspended work platform which is of a durable and reliable construction.

An even further object of the present invention is to provide a new suspended work platform which is susceptible of a low cost of manufacture with regard to both materials and labor, and which accordingly is then susceptible of low prices of sale to the consuming public, thereby making such suspended work platform economically available to the buying public.

Still yet another object of the present invention is to provide a new suspended work platform which provides in the apparatuses and methods of the prior art some of the advantages thereof, while simultaneously overcoming some of the disadvantages normally associated therewith.

Still another object of the present invention is to provide a new suspended work platform for providing a platform for working on projects that can be raised out of the way when not in use.

Yet another object of the present invention is to provide a new suspended work platform which includes a support structure, a platform member, and a suspension structure for suspending the platform member from the support structure. The suspension structure includes a vertical adjustment member, a translational adjustment member, and a turret member to allow adjustment of the vertical position, the horizontal translational position, and the horizontal orientation of the platform member in relation to the support structure.

Still yet another object of the present invention is to provide a new suspended work platform that may be raised, lowered, rotated, moved back and forth for ideal positioning in a work space.

Even still another object of the present invention is to provide a new suspended work platform that can be used as a storage area when not in use.

These together with other objects of the invention, along with the various features of novelty which characterize the invention, are pointed out with particularity in the claims annexed to and forming a part of this disclosure. For a better understanding of the invention, its operating advantages and the specific objects attained by its uses, reference should be had to the accompanying drawings and descriptive matter in which there is illustrated preferred embodiments of the invention.

BRIEF DESCRIPTION OF THE DRAWINGS

The invention will be better understood and objects other than those set forth above will become apparent when consideration is given to the following detailed description thereof. Such description makes reference to the annexed drawings wherein.

DESCRIPTION OF THE PREFERRED EMBODIMENT

Figure 1:
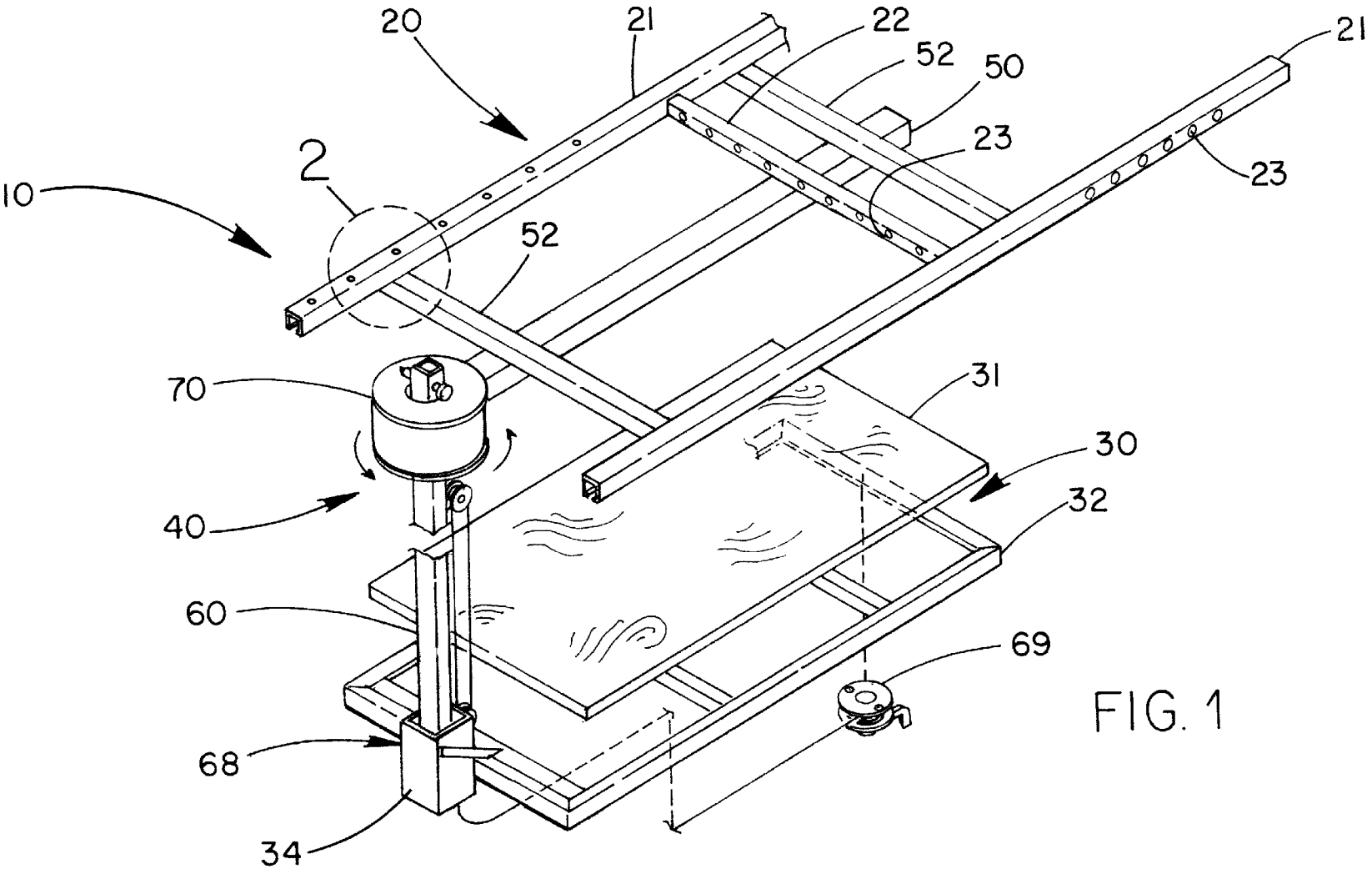
FIG. 1 is a perspective view of a new suspended work platform according to the present invention.
Figure 2:
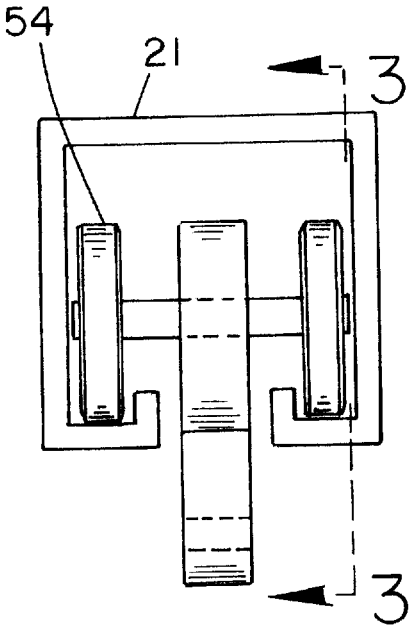
FIG. 2 is a sectional view of the details of the suspension structure mounting to the support structure of the present invention taken from circle 2 on FIG. 1.
Figure 3:
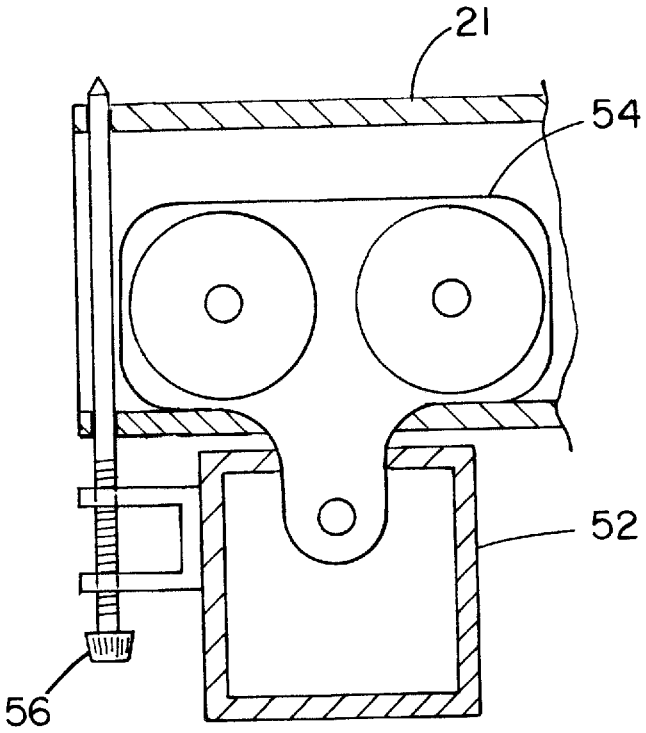
FIG. 3 is a sectional view of the present invention taken from line 3—3 of FIG. 2.
Figure 4:
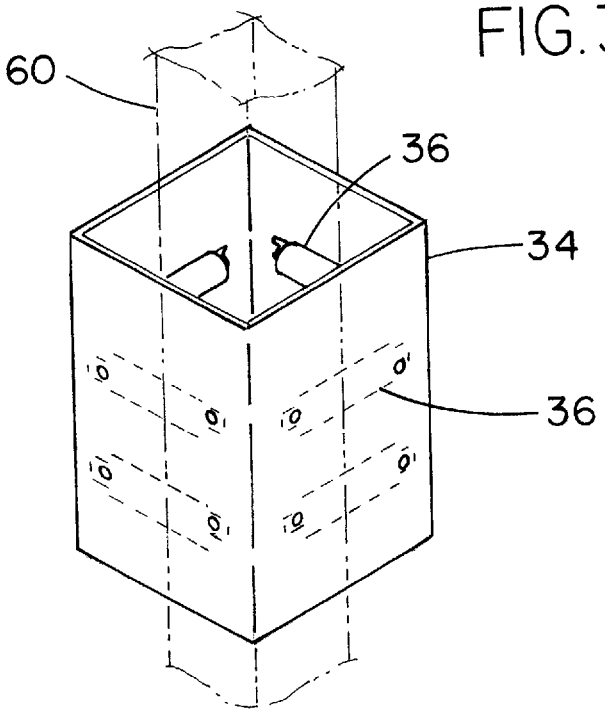
FIG. 4 is a break away perspective view of the platform member mounted on the vertical adjustment member of the present invention.
Figure 5:
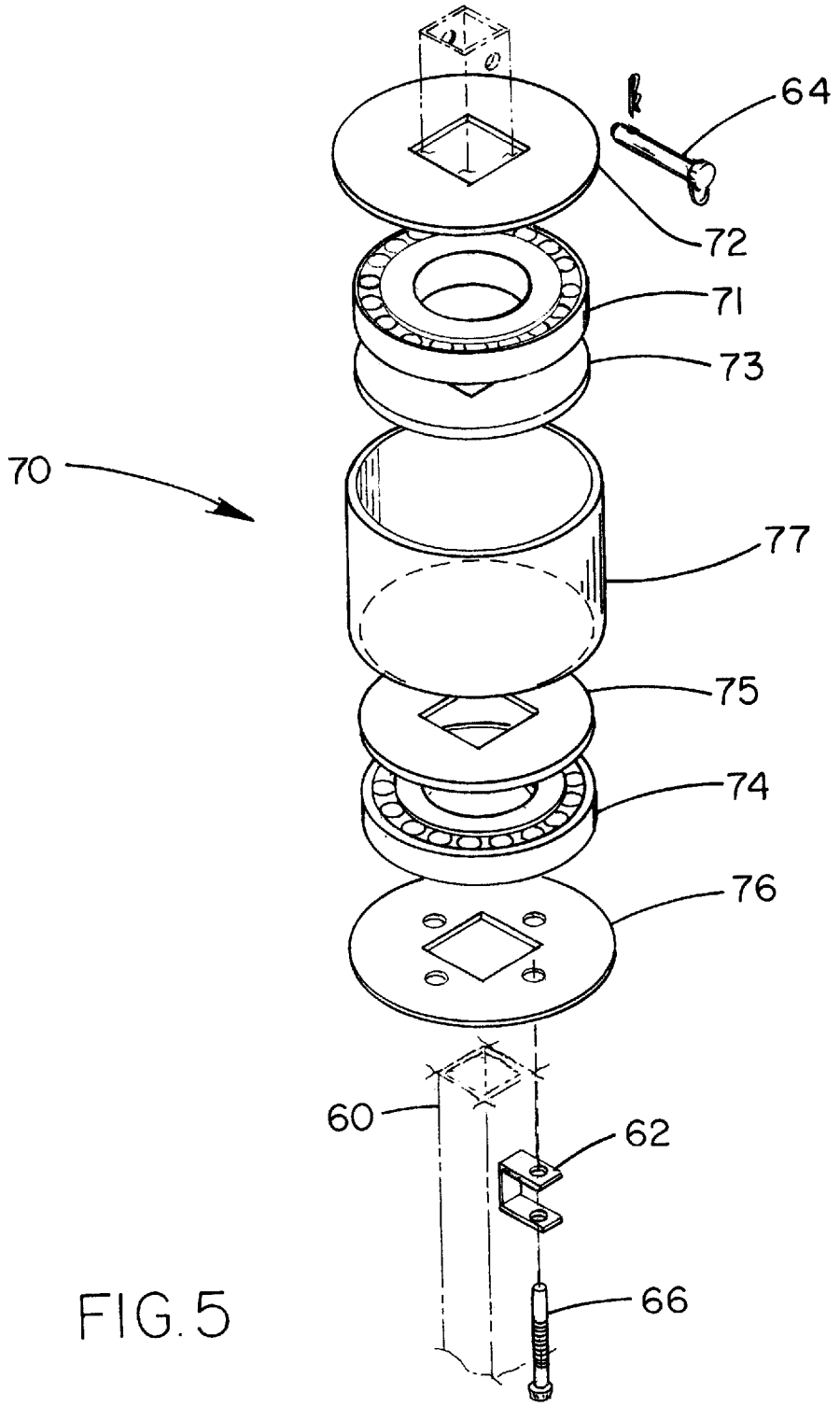
FIG. 5 is an exploded perspective view of the turret member of the present invention.
Figure 6:
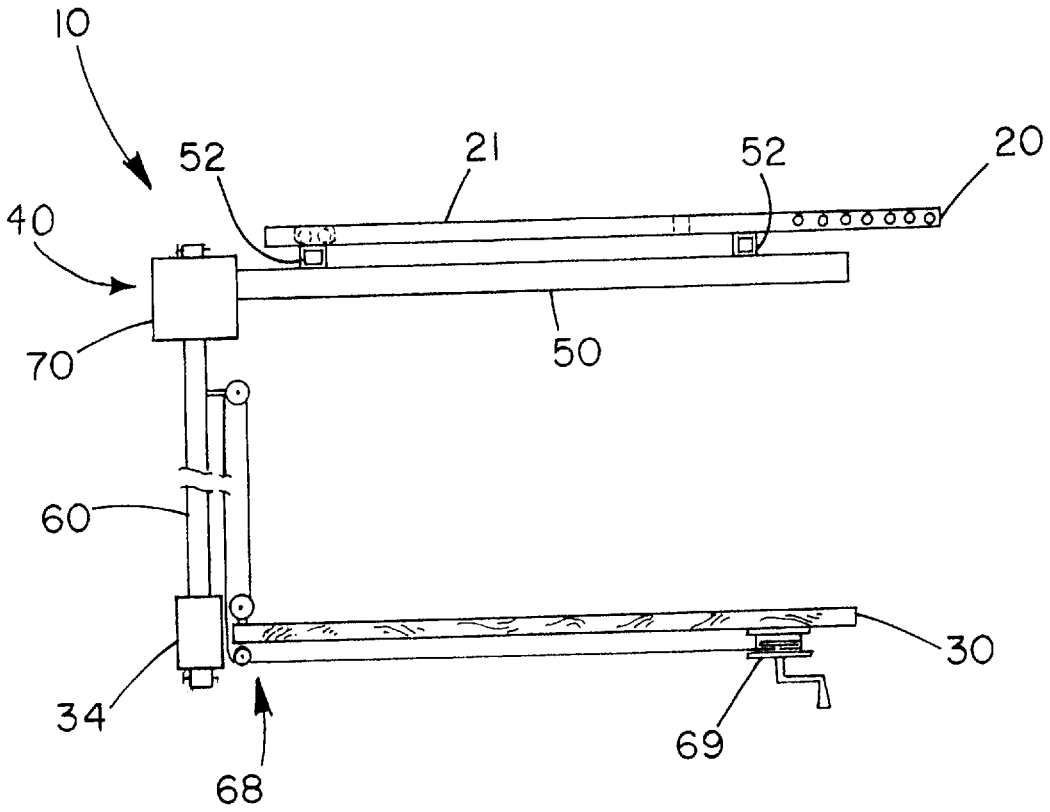
FIG. 6 is a side view of the present invention.

With reference now to the drawings, and in particular to FIGS. 1 through 6 thereof, a new suspended work platform embodying the principles and concepts of the present invention and generally designated by the reference numeral 10 will be described.

As best illustrated in FIGS. 1 through 6, the suspended work platform 10 comprises a support structure 20, a platform member 30, and a suspension structure 40 for suspending the platform member 30 from the support structure 20. The suspension structure 40 also allows adjustment of the vertical position, the horizontal translational position, and the horizontal orientation of the platform member 30 in relation to the support structure 20.

Preferably, the support structure 20 includes a pair of spaced apart elongate trolley guide rails 21. At least one cross beam 22 extends between the trolley guide rails 21 to provide additional support to the support structure 20. Optionally, the trolley guide rails 21 and the cross beam 22 may include tool holding means 23 such as holes, angle brackets, and hooks for holding tools, hoses and electrical cords on the support structure 20.

In use, the support structure 20 is designed to be suspended from a superstructure such as the floor joists in a basement or roof trusses of a garage. The support structure 20 also include optional legs to be self-suspending from the ground.

The platform member 30 is designed to be suspended from the support structure and has a substantially planar upper surface 31 to provide a flat work surface. Ideally, the platform member includes a platform frame 32 with a removable upper planar surface 31. Optionally, the platform member may include retractable legs to provide additional support to the platform member 30 while in use in the lowered position.

The suspension structure 40 generally includes a translational adjustment member 50, a vertical adjustment member 60, and a rotating turret member 70. The suspension structure 40 is designed for suspending the platform member 30 from the support structure 20.

The suspension structure 40 provides a translational adjustment means for adjusting the horizontal translational position of the platform member 30 in relation to the position of the support structure 20. Preferably, the translational adjustment member 50 performs this function.

The translational adjustment member 50 is slidably mounted on the support structure 20 for permitting horizontal translation movement of the translational adjustment member 50 in relation to the support structure 20. This allows translational positioning of the platform member 30 as desired.

Ideally, the translational adjustment member 50 has a plurality of mounting cross beams 52 that are mounted by trolley wheel assemblies 54 at their ends to the respective trolley guide rails 21.

Preferably, the translational adjustment member 50 also includes an adjustable stop means 56 such as a lock pin. The adjustable stop means 56 is designed to releasably hold the translational adjustment member 50 at a position along the horizontal length of the support structure 20.

The suspension structure 40 includes a rotation means for rotating orientation of the platform member 30 in a substantially horizontal plane in relation to the orientation of the support structure 20. Preferably, this is accomplished by rotationally mounting the vertical adjustment member 60 to the translation adjustment member 50. This permits the orientation of the platform member 30 to be rotated in a substantially horizontal plane in relation to the orientation of the support structure 20.

Ideally, the vertical adjustment member 60 is mounted to the translation adjustment member 50 by a turret member 70. The turret member 70 comprises an upper roller bearing 71 between a top plate 72 and a top collar 73 and a lower roller bearing 74 between bottom collar 75 and a bottom plate 76 all contained within a housing 77. The top end of the vertical adjustment member 60 is inserted through the turret member 70 and held in place by a lower bracket 62 and a top pin 64. The turret member 70 is designed to rotate so that the orientation of platform member 30 may be rotated in a substantially horizontal plane in relation to the support structure 20.

The suspension structure 40 also includes a stop means 66 for releasably holding the platform member 30 at a orientation in relation to the support structure 20. Ideally the stop means 66 is a lock pin that is inserted through the lower bracket and a hole provided on the bottom plate to prevent the turret member from rotating.

The suspension structure 40 also includes a vertical adjustment means 68 for adjusting the vertical position of the platform member 30 in relation to the position of the support structure 20.

Preferably, the platform member 30 includes a mounting sleeve 34 on one side which is disposed on the vertical adjustment member 60 to slidably mount the platform member 30 on the vertical adjustment member 60. Ideally, the mounting sleeve includes a plurality of bearings 36 such as Timken bearings therewithin. This allows the vertical position of the platform member 30 to be adjusted in relation to the position of the support structure 20 by sliding the mounting sleeve 34 along the length of the vertical adjustment member 60.

Also included in the vertical adjustment means 68 is a position adjustment means 69 for adjusting the position of the platform member 30 along the length of the vertical adjustment member 60. Ideally, the position adjustment means 69 is a winch assembly that allows for adjusting the position of the platform member 30 along the length of the vertical adjustment member 60.

In use, the platform member 30 can be raised for storage or lowered for use by the winch assembly 69. The turret member 7-allows the platform member 30 to be swiveled as desired to better accommodate a user. Similarly, the translational adjustment member 50 allows the platform member 30 to be adjusted along a line parallel the length of the support structure 20.

As to a further discussion of the manner of usage and operation of the present invention, the same should be apparent from the above description. Accordingly, no further discussion relating to the manner of usage and operation will be provided.

With respect to the above description then, it is to be realized that the optimum dimensional relationships for the parts of the invention, to include variations in size, materials, shape, form, function and manner of operation, assembly and use, are deemed readily apparent and obvious to one skilled in the art, and all equivalent relationships to those illustrated in the drawings and described in the specification are intended to be encompassed by the present invention.

Therefore, the foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be resorted to, falling within the scope of the invention.

I claim:

1. A work platform comprising:

a support structure:

a platform member;

a suspension structure for suspending said platform member from said support structure, said suspension structure including:

a vertical adjustment means for adjusting the vertical position of said platform member in relation to the position of said support structure, a translational adjustment means for adjusting the horizontal translational position of said platform member in relation to the position of said support structure, and a rotation means for rotating in a substantially horizontal plane the orientation of said platform member in relation to the orientation of said support structure;

wherein said platform member has a substantially planar upper surface;

wherein said vertical adjustment means further comprises a vertical adjustment member, said platform member having a mounting sleeve being slidably mounted on said vertical adjustment member to permit adjustment of the vertical position of said platform member in relation to the position of said support structure;

a hand crankable winch for adjusting the position of said platform member along the length of said vertical adjustment member, said winch being positioned at a distal edge of said platform member with respect to said suspension structure;

a first pulley coupled to said mounting sleeve;

a second pulley coupled to said vertical adjustment member, said first pulley and said second pulley being substantially vertically aligned with respect to each other;

a cable having a first end coupled to said winch, said cable having a first portion extending substantially horizontally between said winch and an outer perimeter of said first pulley, said cable having a second portion extending substantially vertically between said first pulley and an outer perimeter of said second pulley, said cable having a third portion extending between said second pulley and said first pulley substantially parallel to and in spaced relationship with said second portion of said cable, said cable having a second end opposite said first end coupled to said first pulley such that actuation of said winch vertically adjusts the position of said platform member.

2. The work platform of claim 1, wherein said translational adjustment means includes a translational adjustment member being slidably mounted on said support structure for permitting horizontal translation movement of said translational adjustment member in relation to said support structure.

3. The work platform of claim 2, further comprising an adjustable stop means for releasably holding said translational adjustment member at a position along the horizontal length of said support structure.

4. The work platform of claim 1, wherein said rotation means includes a turret member, said turret member permitting rotation in a substantially horizontal plane of the orientation of said platform member in relation to said support structure.

5. The work platform of claim 4, further comprising a stop means for releasably holding said platform member at an orientation in relation to the orientation of said support structure.

6. The work platform of claim 4, wherein said turret is coupled to an uppermost end of said vertical adjustment member for permitting said vertical adjustment member and said platform member to be held in a static position with respect to each other when said platform member is rotated horizontally with respect to the support structure such that said winch and said first and second pulleys are held in a static positional orientation with respect to each other when said platform member is rotated.

7. The work platform of claim 4, wherein the turret member includes an upper roller bearing between a top plate and a top collar and a lower roller bearing between a bottom collar and a bottom plate all contained within a housing.

8. A suspended work platform comprising:

a support structure, a platform member, and a suspension structure for suspending the platform member from the support structure;

the suspension structure further being for allowing adjustment of the vertical position, the horizontal translational position, and the horizontal orientation of the platform member in relation to the support structure;

wherein the support structure comprises a pair of spaced apart elongate trolley guide rails;

a cross beam extending between the trolley guide rails for providing additional support to the support structure;

wherein the trolley guide rails and the cross beam include a tool holding means adapted for holding tools, hoses and electrical cords on the support structure;

wherein the tool holding means is one holder type chosen from the group of holder types consisting of holes, angle brackets, and hooks;

wherein the support structure is adapted to be suspended from a superstructure;

the support structure having legs adapted for selectively suspending the support structure from the ground;

the platform member being for suspending from the support structure, the platform member having a substantially planar upper surface for providing a flat work surface;

wherein the platform member comprises a platform frame having a removable upper planar surface;

the platform member having retractable legs for providing additional support to the platform member while in use in a lowered position;

the suspension structure comprising a translational adjustment member, a vertical adjustment member, and a rotating turret member;

the translational adjustment member having a translational adjustment means for adjusting the horizontal translational position of the platform member in relation to the position of the support structure;

the translational adjustment member being slidably mounted on the support structure for permitting horizontal translation movement of the translational adjustment member in relation to the support structure;

the translational adjustment member having a plurality of mounting cross beams, each end of each mounting cross beam being mounted to a respective trolley guide rails by trolley wheel assemblies;

the translational adjustment member having an adjustable first stop means for releasably holding the translational adjustment member at a position along the horizontal length of the support structure;

the adjustable stop means being a first lock pin;

the vertical adjustment member being rotationally mounted to the translation adjustment member for providing a rotation means for rotating orientation of the platform member in a substantially horizontal plane in relation to the orientation of the support structure;

the vertical adjustment member being mounted to the translation adjustment member by the turret member;

the turret member comprising an upper roller bearing between a top plate and a top collar and a lower roller bearing between a bottom collar and a bottom plate all contained within a housing;

a top end of the vertical adjustment member being inserted through the turret member and held in place by a lower bracket and a top pin;

the turret member being rotatable such that the orientation of platform member is rotatable in a substantially horizontal plane in relation to the support structure;

the suspension structure having a second stop means for releasably holding the platform member at an orientation in relation to the support structure;

the second stop means being a second lock pin insertable through the lower bracket and the bottom plate whereby the turret member is prevented from rotating;

the suspension structure having a vertical adjustment means for adjusting the vertical position of the platform member in relation to the position of the support structure;

the platform member having a mounting sleeve disposed on the vertical adjustment member for slidably mounting the platform member on the vertical adjustment member;

the mounting sleeve having a plurality of bearings for allowing the vertical position of the platform member to be adjusted in relation to the position of the support structure by sliding the mounting sleeve along a length of the vertical adjustment member;

the vertical adjustment means further having a winch assembly for adjusting the position of the platform member along the length of the vertical adjustment member; and the winch assembly being for raising and lowering said platform between a storage position and a use position.

* * * * *